US009969952B2

(12) United States Patent
Norn et al.

(10) Patent No.: US 9,969,952 B2
(45) Date of Patent: May 15, 2018

(54) REFINED VEGETABLE OIL AND A METHOD OF PRODUCING IT

(75) Inventors: Viggo Creemers Norn, Stouby (DK); Lars Preuss Nielsen, Juelsminde (DK)

(73) Assignee: PALSGAARD A/S, Juelsminde (DK)

( * ) Notice: Subject to any disclaimer, the term of this patent is extended or adjusted under 35 U.S.C. 154(b) by 1267 days.

(21) Appl. No.: 13/822,538

(22) PCT Filed: Sep. 13, 2011

(86) PCT No.: PCT/EP2011/065864

§ 371 (c)(1),
(2), (4) Date: Apr. 11, 2013

(87) PCT Pub. No.: WO2012/035020

PCT Pub. Date: Mar. 22, 2012

(65) Prior Publication Data

US 2013/0323396 A1 Dec. 5, 2013

Related U.S. Application Data

(60) Provisional application No. 61/382,539, filed on Sep. 14, 2010.

(30) Foreign Application Priority Data

Sep. 13, 2010 (EP) ..... 10176400

(51) Int. Cl.
*C11B 3/06* (2006.01)
*C11B 3/00* (2006.01)
*C11B 3/08* (2006.01)

(52) U.S. Cl.
CPC ..... *C11B 3/006* (2013.01); *C11B 3/001* (2013.01); *C11B 3/06* (2013.01); *C11B 3/08* (2013.01)

(58) Field of Classification Search
CPC ..... C11B 3/06; C11B 3/006
See application file for complete search history.

(56) References Cited

U.S. PATENT DOCUMENTS

| | | | | |
|---|---|---|---|---|
| 5,414,100 | A | 5/1995 | Ayorinde et al. | |
| 6,197,357 | B1 * | 3/2001 | Lawton | C11B 3/06 426/330.6 |
| 6,506,916 | B2 | 1/2003 | Bertholet | |
| 6,579,996 | B2 * | 6/2003 | Peter | C11B 3/06 554/15 |
| 2001/0005759 | A1 | 6/2001 | Bertholet | |

FOREIGN PATENT DOCUMENTS

| | | | |
|---|---|---|---|
| CN | 101319167 | A | 12/2008 |
| JP | S63-250345 | | 10/1988 |
| JP | H 07-197089 | A | 8/1995 |
| JP | H 08-322475 | A | 12/1996 |
| JP | 2002-165561 | A | 6/2002 |
| JP | P2006-83343 | A | 3/2006 |
| JP | 2002-522627 | | 7/2012 |
| JP | 2016-196640 | A | 11/2016 |
| WO | WO 2000/09637 | A1 | 2/2000 |
| WO | WO 2012/035020 | A1 | 3/2012 |

OTHER PUBLICATIONS

"Acid-base reactions a la Bronsted—Chemistry Libre Texts". Available online as of Sep. 13, 2016 from chem.libretexts.org. pp. 1-8.*
Hammond, et al. "Chapter 13: Soybean Oil". Baileys Industrial Oil and Fat Products, Sixth Ed. Ed. Shahidi, 2005. pp. 1-77.*
English (Machine) Translation of JP Published Application No. P2006-83343A, (Mar. 30, 2006).
CN Office Action dated Nov. 15, 2015 in related CN Published Application No. CN103201365A.
English PAJ of JP P2006-83343A.
English translation of CN101319167A.
Database FSTA [Online] 16 International Food Information Service (IFIS). Frankfurt-Main, DE; Bhattacharyya A C et al: "Refining of high FFA rice bran oil by mixed solvent-alkali neutralisation process.", XP002630193, Database accession No. FS-1986-09-N-0016.
Database FSTA [Online] International Food Information Service (IFIS), Frankfurt-Main, DE; Li Gui-Hua et al: "Study of the esterification of FFA in rice bran oil containing high acid value with glycerin.", XP002630194, Database accession No. FS-2002-11-Ne0686.
Database FSTA [Online] International Food Information Service (IFIS), Frankfurt-Main, DE; Krishna De B et al: "Effect of different degumming processes and some nontraditional neutralizing agent on refining of RBO.", XP002630195, Database accession No. FS-2010-07-Ne1024; Journal of Oleo Sci., vol. 59, No. 3, 2010, pp. 121-125.
Database FSTA [Online] International Food Information Service (IFIS), Frankfurt-Main, DE; Kornkanok Aryusuk et al: "Effects of crude rice bran oil components on alkali-refining loss.", XP002630196, Database accession No. FS-2008-07-Me1831; J Am Oil Chem Soc., vol. 85, 2008, pp. 475-479.
Krishna De et al., "Effect of different degumming processes and some nontraditional neutralizing agent on refining of RBO", Journal of Oleo Science, 2010, pp. 121-125.
Aryusuk et al., "Effects of crude rice bran oil components on alkali-refining loss", J Am Oil Chem Soc, 2008, pp. 475-479.
International Search Report of PCT/EP2011/065864 dated Dec. 22, 2011.
International Preliminary Report on Patentability of PCT/EP2011/065864 dated Sep. 18, 2012.
English Translation (Summary) of "Notice of Rejection" issued by JPO in JP Application No. 2013-527644, Date of Draft May 25, 2015.
English Abstract of S63-250345, (Oct. 18, 1988).
English language Abstract of JP 2002-165561 A (Jun. 11, 2002).
(Continued)

*Primary Examiner* — Jenna A Watts
(74) *Attorney, Agent, or Firm* — Hershkovitz & Associates, PLLC; Abe Hershkovitz

(57) ABSTRACT

The present invention relates to a refined vegetable oil as well as a method of producing it. The method uses the combination of a polyol-containing solvent, such as glycerol, and an alkalizing agent for selectively extracting free fatty acids from the vegetable oil.

14 Claims, No Drawings

(56) References Cited

OTHER PUBLICATIONS

English language Abstract of JPH 07-197089 A (Aug. 1, 1995).
English language Abstract of JPH 08-322475 A (Dec. 10, 1996).
English language Abstract of JP 2016-196640 A (Nov. 24, 2016).
Office Action dated Apr. 25, 2017 in related Japan Patent Application No. 2013-527644.

* cited by examiner

REFINED VEGETABLE OIL AND A METHOD OF PRODUCING IT

CROSS-REFERENCE TO RELATED APPLICATIONS

The present Application is a U.S. National Phase of PCT/EP2011/065864 filed on Sep. 13, 2011 ("PCT Application"), which claims priority from U.S. Provisional Application No. 61/382,539 filed on Sep. 14, 2010 and European Patent Application No. EP 10176400.9, filed on Sep. 13, 2010. The PCT Application, the U.S. Provisional application and the European Patent Application are hereby incorporated by reference in their entirety into the present Application. The PCT application, incorporated by reference herein, includes any amendments entered in the PCT application.

FIELD OF THE INVENTION

The present invention relates to a refined vegetable oil as well as a method of producing it. The method uses the combination of a polyol-containing solvent, such as glycerol, and an alkalizing agent for selectively extracting free fatty acids from the vegetable oil.

BACKGROUND

Edible oils can be obtained from a number of different vegetable raw materials from which the oils are derived. The oils may be extracted using an organic solvent like hexane or they may be derived from the vegetable crops by mechanical methods such as hydraulic pressing (Anderson (2005)).

The crude vegetable oils from such processes will besides glycerides, i.e. fatty acid esters of glycerol, contain a number of other components of which lecithins (phosphatides) and free fatty acids typically are the most predominant ones. Especially the free fatty acids may constitute a significant portion of a crude vegetable oil and are perceived as undesirable components of the vegetable oil, as they affect its organoleptic properties. The free fatty acids are formed by hydrolysis of triglyceride in reactions taking place due to damages of the crop during harvesting and/or storage of the seeds or fruits before the extraction of the oils take place.

For an oil of a good quality it is generally required that those minor components are reduced to a low concentration to provide a vegetable oil product having a bland taste and an acceptable smell. Codex Alimentarius (Codex Alimentarius; Fats, Oils and Related Products, vol. 8, 2. ed. FAO/WHO Rome 1993) generally recommends an acid value of maximum 0.6 equivalent to approx. 0.3% free fatty acids for edible oils.

To meet the demand for high quality and agreeable taste the crude vegetable oils are typically refined by chemical and/or physical processes to remove a number of minor constituents present in the crude oil.

As described by Anderson (2005), a refining process typically includes a degumming step where phosphoric acid is added to the oil, thereby rendering the phospholipids of the oil soluble in water. The water may be removed from the refined vegetable oil by gravity techniques.

Next step is normally the removal of the free fatty acids, also referred to as the deacidification. The deacidification may be performed by the alkaline wash process, which involves the addition of aqueous, diluted lye to the vegetable oil. The lye converts the free fatty acids into the corresponding soaps, which are soluble in water, and which can be removed in a separator followed by a series of washing step with water to provide an acceptable removal of traces of soaps. The alkaline wash-process requires a number of washing step, which consume a significant amount of energy and makes the process complicated and expensive.

Next step of the refining process is typically the bleaching of the degummed, deacidified, vegetable oil. The bleaching may involve addition of bleaching clay like bentonite or silicon dioxide to remove colour components as well as the traces of free fatty acids from the vegetable oil. The addition of the clays often takes place in closed tanks under reduced pressure and after a specified duration the oil is filtered to provide an edible quality oil.

Instead of the above-mentioned alkaline wash process the free fatty acids may be removed by another process. Here the lye addition step is omitted and the bleached oil, now with a high content of free fatty acids, is treated in a steam distillation process known as deodorisation, see e.g. Anderson (2005). In this process the vegetable oil is heated to a high temperature under vacuum. The heating is performed by contacting the vegetable oil directly with superheating steam under conditions which allows for a good contact between the oil and the steam, and thus an efficient distillation. The steam distillation will remove the low boiling components, in this case the free fatty acids, and a number of colouring products as well as off flavour components, thereby yielding a bland and stable vegetable oil. In the case of alkaline washed vegetable oil, a deodorisation will improve the quality by removing the last quantities of free fatty acids. The deodorisation may be implemented as a batch operation in large tanks or it may be implemented continuously in columns equipped with trays or other installations, which provide good contact between steam and oil. An example of a deoderisation process is described in WO 98/18888.

Conventional refining of vegetable oil makes use of high temperature deodorisation (>200 degrees C.) over extended periods of time, which may damage the temperature labile components of the vegetable oil. Additionally, it is well known that the deodorisation can cause the formation of trans fatty acids by thermal rearrangement of unsaturated bonds from the natural occurrence of cis to trans isomers (Harper (2001) and Greyt et al (2005)), and the latter is associated with health risks like heart infarctions.

SUMMARY OF THE INVENTION

An object of the invention is to provide an improved process of refining vegetable oil relative to the processes available in the prior art.

The present inventors have observed that the refining methods of the prior art have deficiencies when it comes to refining vegetable oil containing significant amounts of mono-glycerides, di-glycerides, and free fatty acids. The traditional aqueous alkaline wash is not recommendable since significant amounts of water appear to be absorbed into the vegetable oil and render the subsequent phase separation very challenging if not impossible.

Additionally, the present inventors have observed that deodorisation (high temperature distillation) has the disadvantage that it also removes the low boiling lipids and natural components like tocopherols (a natural antioxidant including vitamin E), which are present in most vegetable oils. Even with careful processing the loss of product quality and product yield will be significant.

The present inventors have discovered that, surprisingly, an improved refining process is obtained by extracting the vegetable oil with a polyol-containing solvent in the presence of an alkalizing agent.

Thus, an aspect of the invention relates to a method of producing a refined vegetable oil, the method comprising the steps of:

a) providing a vegetable oil comprising triglycerides, diglycerides, monoglycerides and free fatty acids,
b) contacting the vegetable oil with a polyol-containing solvent and an alkalizing agent, thereby forming a first composition,
c) exposing the first composition to conditions suitable for extracting free fatty acids to the polyol-containing solvent,
d) forming a phase-separated system comprising a separate polyol-containing solvent phase and a separate oil phase,
e) recovering the oil phase from the phase-separated system of step d), thereby obtaining a refined vegetable oil.

The method of the invention surprisingly results in a higher yield of refined vegetable oil than prior art refining processes.

Additionally, the present invention offers a clear advantage in refining edible oils as the process does not expose the oils to high temperatures for extended periods of time, which is the case with the deodorisation process. This is an advantage as it reduces the formation of trans fatty acids as well as other components (e.g. dimerisation products, oxidation products, etc.), which typically are found in connection with high temperature reactions of lipid and lipid constituents.

Yet an aspect of the invention relates to a refined vegetable oil, e.g. a refined vegetable oil obtainable by the method described herein.

Additional objects and advantages of the invention are described below.

DETAILED DESCRIPTION OF THE INVENTION

As said, an aspect of the invention relates to a method of producing a refined vegetable oil, the method comprising the steps of:

a) providing a vegetable oil comprising triglycerides, diglycerides, monoglycerides and free fatty acids,
b) contacting the vegetable oil with a polyol-containing solvent and an alkalizing agent, thereby forming a first composition,
c) exposing the first composition to conditions suitable for extracting free fatty acids to the polyol-containing solvent,
d) forming a phase-separated system comprising a separate polyol-containing solvent phase and a separate oil phase,
e) recovering the oil phase from the phase-separated system of step d), thereby obtaining a refined vegetable oil.

In the context of the present invention, the term "oil" relates to a composition containing a significant amount of triglycerides. The term is not limited to substances which are liquid at or below room temperature, but also encompasses substances which are on solid form at room temperature or even above room temperature, and which sometimes are referred to as "fats".

The term "vegetable oil" relates to an oil prepared from plant or vegetable products. Vegetable oils may for example be prepared by pressing oil-containing vegetable products such as e.g. rapeseed or linseed.

The vegetable oil may for example be fractionated oil, such as palm stearin or palm olein. Fractionation of oils may e.g. be performed by a so-called winterisation process, where an oil is cooled and partially crystallised, and where the crystallised oil is separated from liquid, non-crystallised oil to provide a first oil fraction melting at a relatively low temperature and a second oil fraction melting at a higher temperature.

In some embodiments of the invention the vegetable oil comprises one or more vegetable oil(s) selected from the group consisting of palm oil, palm kernel oil, olive oil, soy oil, rapeseed oil, sunflower oil, safflower oil, cottonseed oil, shea butter, coconut oil, cocoa butter, linseed oil, corn oil, rice bran oil, avocado oil, and a combination thereof.

The vegetable oil may comprises, or essentially consist of, oat oil. Thus, in some embodiments of the invention the vegetable oil comprises one or more vegetable oil(s) selected from the group consisting of palm oil, palm kernel oil, olive oil, soy oil, rapeseed oil, sunflower oil, safflower oil, cottonseed oil, shea butter, coconut oil, cocoa butter, linseed oil, corn oil, rice bran oil, avocado oil, oat oil, and a combination thereof.

Useful vegetable oils and their production are e.g. described in Gunstone (2002), which is incorporated herein by reference for all purposes.

The present method is particularly useful for refining vegetable oil derived from plants wherein the oil predominantly is present in the mesocarp and/or pericarp of the fruit or for plants where the oilfruit or oilseed is exposed to enzymatic degradation when the oilfruit or oilseed is damaged.

In some preferred embodiments of the invention, the vegetable oil comprises, or even essentially consists of, palm oil.

In other preferred embodiments of the invention, the vegetable oil comprises, or even essentially consists of, olive oil.

In other preferred embodiments of the invention, the vegetable oil comprises, or even essentially consists of, avocado oil.

It has been found that the present method is particularly attractive to use for refining low grade unrefined vegetable oils, i.e. vegetable oils which due to unfavourable harvest or storage conditions have a high content of free fatty acids. Such vegetable oils would be difficult and most likely economically unattractive to deacidify using the prior art technology.

In some preferred embodiments of the invention, the vegetable oil comprises, or even essentially consists of, a crude vegetable oil, i.e. a vegetable oil which has not been exposed to any refining step.

In some preferred embodiments of the invention, the vegetable oil comprises, or even essentially consists of, an un-deacidified vegetable oil, i.e. a vegetable oil which has not been exposed to any refining step, which removes free fatty acids.

In some embodiments of the invention, the vegetable oil is a degummed vegetable oil, i.e. a vegetable oil in which the phospholipids have been partly or fully removed. Degumming may e.g. be performed enzymatically or chemically. It may for example involve addition of an aqueous solution of phosphoric acid to the phospholipid-containing oil, thereby rendering the phospholipids of the oil soluble in water. The water may be removed from the vegetable oil by gravity techniques. More details regarding degumming can be found in Anderson (2005).

In some embodiments of the invention, the vegetable oil is a bleached vegetable oil. Details regarding degumming can be found in Anderson (2005). In some embodiments of the invention it may even be preferred that the vegetable oil is a degummed and bleached vegetable oil.

In some embodiments of the invention, water has been at least partly removed from the vegetable oil provided in step a)

The vegetable oil contains significant amounts of triglyceride. However, the specific amount depends on the quality of the vegetable oil.

In some embodiments of the invention the vegetable oil contains triglyceride in an amount of at least 50% by weight relative to the weight of the vegetable oil. For example, the vegetable oil may contain triglyceride in an amount of at least 60% by weight relative to the weight of the vegetable oil, preferably at least 70%, and even more preferred at least 75% by weight relative to the weight of the vegetable oil.

The vegetable oil may e.g. contain triglyceride in an amount in the range of 50-98% by weight relative to the weight of the vegetable oil. For example, the vegetable oil may contain triglyceride in an amount in the range of 55-95% by weight relative to the weight of the vegetable oil, preferably in the range of 60-90%, and even more preferably in the range of 65-85% by weight relative to the weight of the vegetable oil.

In addition to triglyceride, the vegetable oil typically contains free fatty acids, mono-glyceride and di-glyceride.

In some embodiments of the invention the vegetable oil contains a total amount of mono-glyceride of at least 0.1% by weight relative to the weight of the vegetable oil. For example, the vegetable oil may contain mono-glyceride in a total amount of at least 0.5% by weight relative to the weight of the vegetable oil, preferably at least 1%, and even more preferred at least 2.5% by weight relative to the weight of the vegetable oil.

The vegetable oil may e.g. contain mono-glyceride in an amount in the range of 0.1-10% by weight relative to the weight of the vegetable oil. For example, the vegetable oil may contain mono-glyceride in an amount in the range of 0.5-8% by weight relative to the weight of the vegetable oil, preferably in the range of 1-6%, and even more preferably in the range of 2-5% by weight relative to the weight of the vegetable oil.

In some embodiments of the invention, the vegetable oil contains a total amount of di-glyceride of at least 0.2% by weight relative to the weight of the vegetable oil. For example, the vegetable oil may contain di-glyceride in a total amount of at least 1% by weight relative to the weight of the vegetable oil, preferably at least 2%, and even more preferred at least 5% by weight relative to the weight of the vegetable oil.

The vegetable oil may e.g. contain di-glyceride in an amount in the range of 0.2-20% by weight relative to the weight of the vegetable oil. For example, the vegetable oil may contain di-glyceride in an amount in the range of 1-16% by weight relative to the weight of the vegetable oil, preferably in the range of 2-12%, and even more preferably in the range of 4-10% by weight relative to the weight of the vegetable oil.

An advantage of the present process is that it can handle vegetable oil raw material having a relatively high free acid content, and this in a cost efficient manner.

In some embodiments of the invention the vegetable oil contains free fatty acids in amount of at least 0.5% by weight relative to the weight of the vegetable oil. For example, the vegetable oil may contain free fatty acids in a total amount of at least 1% by weight relative to the weight of the vegetable oil, preferably at least 5%, and even more preferred at least 10% by weight relative to the weight of the vegetable oil.

In the context of the present invention the term "free fatty acids" relates to free, unesterified fatty acids and encompasses both protonated and deprotonated free fatty acids, as well as salts of the free fatty acids.

The vegetable oil may e.g. contain free fatty acids in an amount in the range of 0.5-25% by weight relative to the weight of the vegetable oil. For example, the vegetable oil may contain free fatty acids in an amount in the range of 1-22% by weight relative to the weight of the vegetable oil, preferably in the range of 5-20%, and even more preferably in the range of 10-18% by weight relative to the weight of the vegetable oil.

For example, the vegetable oil may e.g. contain free fatty acids in an amount in the range of 3-25% by weight relative to the weight of the vegetable oil. The vegetable oil may e.g. contain free fatty acids in an amount in the range of 5-22% by weight relative to the weight of the vegetable oil, preferably in the range of 10-20%, and even more preferably in the range of 12-18% by weight relative to the weight of the vegetable oil.

The vegetable oil may additionally contain other components such as waxes, phospholipids (e.g. lecithin), sterols, squalene, aliphatic alcohols, chlorophyll, natural antioxidants (e.g. tocopherols, tocotrienols, carotenes), and/or water. It is particularly preferred that the vegetable oil contains phospholipids. It is furthermore preferred that the vegetable oil contains one or more natural antioxidant(s).

In the context of the present invention, the phrase "Y and/or X" means "Y" or "X" or "Y and X". Along the same line of logic, the phrase "$X_1, X_2, \ldots, X_{i-1}$, and/or X," means "$X_1$" or "$X_2$" or . . . or "$X_{i-1}$" or "$X_i$" or any combination of the components: $X_1$, $X_2$, . . . $X_{i-1}$, and $X_i$.

In some embodiments of the invention the vegetable oil comprises a mixture of at least two different vegetable oils prepared from different types of plants.

In some embodiments of the invention the vegetable oil comprises an inter-esterified vegetable oil, or an inter-esterified mixture of at least two different vegetable oils prepared from different types of plants.

In some embodiments of the invention the vegetable oil comprises a hydrogenated vegetable oil.

It is presently preferred that the vegetable oil only contains a limited amount of water, and even more preferably substantially no water.

In some embodiments of the invention, the vegetable oil contains water in amount of at most 2% by weight relative to the weight of the vegetable oil. For example, the vegetable oil may contain water in an amount of at most 1% by weight relative to the weight of the vegetable oil, preferably at most 0.5%, and even more preferred at most 0.2% by weight relative to the weight of the vegetable oil.

In the context of the present invention the term "polyol-containing solvent" relates to a solvent which comprises, or even essentially consists of, one or more polyol(s).

In the context of the present invention the term "polyol" relates to a carbon-based compound comprising at least two alcoholic hydroxyl groups.

In some embodiments of the invention, the polyol-containing solvent comprises, or even essentially consists of, a $c_3$-$c_8$ polyol containing at least 3 hydroxyl groups. The polyol-containing solvent may preferably comprise, or even essentially consist of, a $c_3$-$c_6$ polyol containing at least 3 hydroxyl groups.

In some embodiments of the invention the polyol-containing solvent comprises a total amount of polyols of at least 90% by weight relative to the weight of the polyol-containing solvent. The polyol-containing solvent may e.g. comprises a total amount of polyols of at least 95%, preferably at least 98%, and even more preferably at least 99% by weight relative to the weight of the polyol-containing solvent, such as approx. 100% by weight.

In some preferred embodiments of the invention, the polyol-containing solvent comprises, or even essentially consists of, glycerol. For example, the polyol-containing solvent may comprises glycerol in an amount of at least 90% by weight relative to the weight of the polyol-containing solvent, preferably at least 95%, and even more preferably at least 98% by weight relative to the weight of the polyol-containing solvent, such as approx. 100%.

Alternatively, or additionally, the polyol-containing solvent may comprise, or even essentially consist of, sorbitol.

In the context of the present invention the term "essentially consist of" means that the mentioned product or composition consists of the mentioned components as well additional optional components which do not materially affect the basic and novel characteristics of the invention.

The polyol-containing solvent may furthermore comprise an ionic liquid.

The first composition may contain the vegetable oil and the polyol-containing solvent in different amounts.

In some embodiments of the invention the first composition comprises the vegetable oil in an amount of at least 10% by weight relative to the weight of the first composition, preferably at least 20%, and even more preferably at least 30% by weight relative to the weight of the first composition. The first composition may e.g. comprise the vegetable oil in an amount in the range of 10-90% by weight relative to the weight of the first composition, preferably in the range of 20-80%, and even more preferably in the range of 30-70% by weight relative to the weight of the first composition.

In some embodiments of the invention the first composition comprises the polyol-containing solvent in an amount of at least 10% by weight relative to the weight of the first composition, preferably at least 20%, and even more preferably at least 30% by weight relative to the weight of the first composition. The first composition may e.g. comprise the polyol-containing solvent in an amount in the range of 10-90% by weight relative to the weight of the first composition, preferably in the range of 20-80%, and even more preferably in the range of 30-70% by weight relative to the weight of the first composition.

The alkalizing agent is preferably a salt of an organic or inorganic Brøndsted acid, i.e. an acid which can donate one or more proton(s).

Additionally, the alkalizing agent may be soluble in the polyol-containing solvent and/or in the vegetable oil. Alternatively, the alkalizing agent may be non-soluble in the polyol-containing solvent or dissolve on contact with the free fatty acids. Examples of non-soluble alkalizing agents are e.g. oxides, such as e.g. alkaline metal oxides, ion exchangers containing alkaline functional groups, or other heterogeneous alkalizing agents.

An advantage of using non-soluble alkalizing agents is that they normally can be easily removed from the solvent, e.g. by sedimentation, centrifugation, and/or filtration.

In the context of the present invention, a compound is deemed soluble in a solvent if at least 0.5 g of the compound can be dissolved in 100 g of the solvent at 25 degrees C.

The alkalizing agent may for example be added in powder form or it may be added in liquid form.

In some embodiments of the invention the alkalizing agent is an inorganic salt, e.g. used in solid form or in dissolved form. The alkalizing agent may e.g. comprise one or more inorganic salts selected from the group consisting of a bicarbonate salt, a hydroxide salt, an oxide salt, and combinations thereof.

In some embodiments of the invention the inorganic salt contains a mono-valent metal ion. Useful examples of mono-valent metal ions are a sodium ion and/or a potassium ion.

In some embodiments of the invention the inorganic salt contains a di-valent metal ion. Useful examples of di-valent metal ions are a magnesium ion and/or a calcium ion.

In some embodiments of the invention the inorganic salt contains a tri-valent metal ion. A useful example of a tri-valent metal ion is an aluminium ion.

Examples of useful alkalizing agents are e.g. sodium bicarbonate, potassium bicarbonate, sodium carbonate, potassium carbonate, sodium acetate, trisodium citrate, sodium lactate, ammonium hydrogen carbonate, and a combination thereof. Sodium carbonate is presently preferred.

The first composition preferably contains the alkalizing agent in a molar amount which is comparable to, or less than, the molar amount of free fatty acids in the vegetable oil. Large excess of alkalizing agent may result in an undesirable inter-esterification between the glycerides of the vegetable oil.

In some embodiments of the invention the first composition comprises the alkalizing agent in an amount in the range of 0.1-20% by weight relative to the weight of the first composition. The first composition may e.g. comprise the alkalizing agent in an amount in the range of 0.5-15% by weight relative to the weight of the first composition, preferably in the range of 1-12%, and even more preferably in the range of 2-10% by weight relative to the weight of the first composition.

In other embodiments of the invention the first composition comprises the alkalizing agent in an amount in the range of 0.01-10% by weight relative to the weight of the first composition. The first composition may e.g. comprise the alkalizing agent in an amount in the range of 0.04-5% by weight relative to the weight of the first composition, preferably in the range of 0.08-1%, and even more preferably in the range of 0.1-0.6% by weight relative to the weight of the first composition.

It may be desirable to keep the water content of the first composition to a minimum, particularly if the vegetable oil contains a relatively high content of free fatty acids, monoglyceride, and diglyceride.

Thus, in some embodiments of the invention the first composition comprises water in an amount of at most 20% by weight relative to the weight of first composition. For example, the first composition may contain water in an amount of at most 10% by weight relative to the weight of the first composition, preferably at most 5%, and even more preferred at most 1% by weight relative to the weight of the first composition.

Alternatively, the first composition may contain water in an amount of at most 6% by weight relative to the weight of the first composition, preferably at most 4%, and even more preferred at most 2% by weight relative to the weight of the first composition.

In other embodiments of the invention even lower amounts of water are preferred, and in these cases the first composition contains water in an amount of at most 1% by weight relative to the weight of the first composition, preferably at most 0.5%, and even more preferred at most 0.2% by weight relative to the weight of the first composition.

In some embodiments of the invention the vegetable oil comprises at most 5% free fatty acids by weight relative to the weight of the vegetable oil, and the first composition comprises at most 10% water by weight relative to the weight of the first composition.

In some embodiments of the invention the vegetable oil comprises at most 10% free fatty acids by weight relative to the weight of the vegetable oil, and the first composition comprises at most 5% water by weight relative to the weight of the first composition.

In some embodiments of the invention the vegetable oil comprises at most 15% free fatty acids by weight relative to the weight of the vegetable oil, and the first composition comprises at most 2% water by weight relative to the weight of the first composition.

In some embodiments of the invention the vegetable oil comprises at most 20% free fatty acids by weight relative to the weight of the vegetable oil, and the first composition comprises at most 0.5% water by weight relative to the weight of the first composition.

In addition to the above described extraction with polyol-containing solvent the inventors have discovered that by using alkaline mixtures of polyol-containing solvent and an auxiliary solvent, e.g. simple esters or organic solvents like ethyl acetate, the extraction can be even more selective with respect to removal of free fatty acid with a minimum of co-extraction of glycerides, thereby providing an improved yield of the vegetable oil.

Thus, the first composition may furthermore comprise an auxiliary solvent. The auxiliary solvent is preferably more lipophilic than the polyol-containing solvent and preferably has a relatively low boiling point. Additionally, the auxiliary agent is preferably non-toxic.

In some embodiments of the invention the auxiliary solvent has a log $P_{octanol/water}$ of at least 0. For example, the auxiliary solvent may have a log $P_{octanol/water}$ of at least 0.2, preferably at least 0.4, and even more preferably at least 0.6. In some preferred embodiments of the invention the auxiliary solvent has a log $P_{octanol/water}$ of at least 0.7.

The parameter log $P_{octanol/water}$ is preferably determined according to OECD guideline 107: Partition Coefficient (n-octanol/water)—Shake Flask Method.

In some embodiments of the invention the auxiliary solvent is an alkane. Examples of useful alkanes are e.g. propane, butane, pentane, hexane, or a mixture thereof.

In some embodiments of the invention the auxiliary solvent is an alcohol. Tert butanol and n-butanol, which may be used separately or as a mixture, are examples of useful alcohols.

In some embodiments of the invention the auxiliary solvent is ester. Examples of useful esters are ethyl acetate, methyl acetate, propyl acetate, butyl acetate, or a mixture thereof.

In some preferred embodiments of the invention, the auxiliary solvent comprises one or more solvent(s) selected from the group consisting of ethyl acetate, methyl acetate, hexane, and tert butanol.

The auxiliary solvent may also comprises, or essentially consist of, ethyl methyl ketone.

In some preferred embodiments of the invention, the auxiliary solvent has a boiling point at atmospheric pressure in the range of 0-150 degrees C. For example, the boiling point of the auxiliary solvent at atmospheric pressure may be in the range of 10-100 degrees C., preferably in the range of 20-80 degrees C., and even more preferably in the range of 30-70 degrees C.

In some embodiments of the invention the auxiliary solvent has a boiling point at atmospheric pressure of at most 100 degrees C. For example, the boiling point of the auxiliary solvent at atmospheric pressure may be at most 90 degrees C., preferably at most 85 degrees C., and even more preferably at most 80 degrees C. The relatively low boiling point allows for removal of the auxiliary agent from the refined vegetable oil by evaporation or distillation.

The auxiliary solvent may be added during step b) and/or during step c). Addition of the auxiliary solvent during step c) is presently preferred.

The extraction of step c) starts as soon as the vegetable oil, polyol-containing solvent, and alkalizing agent are brought in contact, but is speeded up by mixing the components and by elevating temperature of the first composition. The intimate contact between the vegetable oil, the alkalizing agent, and the polyol-containing solvent will cause the free fatty acid and other polar constituents of the unrefined vegetable oil to migrate to the polyol-containing solvent phase and thus leave the vegetable oil with a decreased level of free fatty acids.

The removal of free fatty acids of the present invention normally takes place at low or moderate temperatures contrary to the prior art methods which use relatively high temperatures.

Step c) preferably comprises a first period during which the temperature of the first composition is kept in the range of 5-150 degrees C. For example, during the first period the temperature of the first composition may be kept in the range of 20-130 degrees C., preferably in the range of 30-120 degrees C., and even more preferably in the range 50-110 degrees C.

If the first composition comprises an auxiliary solvent it may be preferred to use a relatively low temperature during the first period. Thus, in some embodiments of the invention the temperature of the first composition during the first period is kept in the range of 20-100 degrees C., preferably 30-90 degrees C., and even more preferably in the range of 40-80 degrees C.

If the first composition does not comprise an auxiliary solvent, higher temperatures may be preferred during the first period. Thus, in some embodiments of the invention the temperature of the first composition during the first period is kept in the range of 50-150 degrees C., preferably 60-140 degrees C., and even more preferably in the range of 80-120 degrees C.

In some embodiments of the invention the auxiliary solvent is added to the first composition during step c).

The temperature of the first composition during the addition of the auxiliary solvent is preferably less than the boiling point of the auxiliary solvent at the pressure at which the addition takes place. The temperature of the first composition during the addition of the auxiliary solvent may for example be at least 5 degrees C. lower than the boiling point of the auxiliary solvent at the pressure at which the addition takes place, preferably at least 10 degrees C. lower, and even more preferably at least 15 degrees C. lower at the pressure at which the addition takes place.

Alternatively, temperatures near, at, or above the boiling point of the auxiliary solvent may be used, particularly if step c) is performed under pressure or using reflux.

The auxiliary solvent may be added to and mixed with the first composition after the first period has ended and subsequently kept at a second temperature for a second period.

Thus, in some preferred embodiments of the invention step c) comprises the steps c1) keeping the temperature of the first composition in a first temperature range during a first period, c2) adding an auxiliary solvent to the first composition, and c3) keeping the temperature of the mix of the auxiliary agent and the first composition in a second temperature range during a second period.

As stated above, it is preferred that the temperature of the first composition in step c2) is adjusted to a temperature below the boiling point of the auxiliary solvent to avoid excessive evaporation of the auxiliary solvent.

The first temperature range may for example be 50-150 degrees C. For example, the first temperature range may be 60-140 degrees C., preferably 70-130 degrees C. and even more preferably 80-120 degrees C. The boiling points and absolute temperatures mentioned herein are temperatures at atmospheric pressure unless stated otherwise. If the pressure during a specific process step is higher or lower than atmospheric pressure the appropriate temperatures will vary accordingly.

The durations of the first period depends on specific conditions during the extraction and can be less than a second, up to several hours, and even longer if one is willing to wait. The duration of the first period may for example be in the range of 0.5 second—24 hours, preferably 1 minute—5 hours, and even more preferably 10 minutes—2 hours. However, the longer the first composition is kept at elevated temperature, the high is the risk of undesirable inter-esterification between the glycerides of the vegetable oil.

The second temperature range may for example be 20-100 degrees C. For example, the second temperature range may be 30-90 degrees C., preferably 40-80 degrees C., and even more preferably 50-70 degrees C.

The durations of the second period also depends on specific conditions during the extraction and can be less than a second, up to several hours, and even longer if one is willing to wait. The duration of the second period may for example be in the range of 0.5 second—24 hours, preferably 1 minute—5 hours, and even more preferably 10 minutes—2 hours.

In some embodiments of the invention the auxiliary solvent is added to the first composition in an amount sufficient to obtain a weight ratio between the auxiliary solvent and the polyol-containing solvent in the range of 1:10-10:1.

In some embodiments of the invention the auxiliary solvent is added to the first composition in an amount sufficient to obtain a weight ratio between the auxiliary solvent and the vegetable oil in the range of 1:10-10:1.

The vegetable oil and the polyol-containing solvent tend to form two separate phases and therefore step c) preferably involves mixing the first composition, optionally including the auxiliary solvent, to increase the effective surface area between the lipophilic phase and polyol-containing solvent. The mixing may be performed in short pulses or it may be continuous during the entire extraction step. Standard mixing equipment may be used for this purpose, see for example Perry (1997).

Normally, step c) is performed under constant mixing. It is however preferred that the first composition, e.g. including the auxiliary solvent, is mixed for at least 1 minute, preferably for at least 15 minutes, and even more preferably for at least 30 minutes.

The method may be optimised for high through-put in which case relative short durations of step c), and particularly of the mixing time, are preferred. In some embodiments of the invention the duration of step c) is at most 10 minutes, preferably at most 5 minutes, and even more preferably at most 1 minute. For example, the duration of step c) may be at most 30 seconds, preferably at most 5 minute, and even more preferably at most 1 second.

Optimally, the mixing results in a large, effective interfacial surface area between the vegetable oil and the polyol-containing solvent, which facilitates rapid extraction of the free fatty acids to the polyol-containing solvent.

As will be apparent for the person skilled in the art, the method of the invention can be implemented in a number of different ways. For example, the two of the ingredients (e.g. the polyol-containing solvent and the vegetable oil) of the first composition may be loaded in a vessel under continuous mixing. The alkalizing agent may subsequently be added to the vessel, and as soon as the alkalizing agent contacts the vegetable oil and the polyol-containing solvent, the first composition is formed and the extraction typically starts immediately upon contact.

An advantage of the method of the present invention relative to the prior art is that the present method is more selective towards removal of free fatty acids and has a lower degree of co-extraction of mono- and diglycerides glycerides. The overall yield of the refined oil is thereby increased.

Additionally, the present method appears to be remove less natural antioxidants, e.g. tocopherols, from the vegetable oil than the methods of the prior art. The refined vegetable, which is obtainable by the present method, may therefore contain a higher amount of native, natural antioxidants (i.e. the natural antioxidants which were present in the unrefined vegetable oil) then refined vegetable oils, which have been prepared using prior art processes. A higher content of natural antioxidants improves the stability and the nutritional benefits of an vegetable oil product.

In step d) a phase-separated system is formed. In the context of the present invention the term "phase-separated system" relates to a composition comprising at least two clearly separated phases. An example of a phase-separated system is e.g. a vegetable oil phase layered on top of a polyol-containing solvent phase, such as a glycerol-containing phase. The mixture of the polyol-containing solvent and the vegetable oil, which may be obtained while mixing the first composition during step c) is not deemed a phase-separated system.

Any suitable way of forming the phase-separated system may be used. For example, the phase-separated system may be formed by stopping the mixing of the first composition and waiting for the first composition to separate into a phase comprising vegetable oil and a phase comprising the polyol-containing solvent including free fatty acids extracted from the vegetable oil and alkalizing agent.

Alternatively, the phase-separated system may be formed by pumping the mixture formed during step c) through a phase separator, such as a centrifuge or an extraction column for continuous phase separation (e.g. a mixer-settler column). Useful systems can be found in Perry (1997), which is incorporated herein by reference for all purposes.

In step e) the refined oil phase is recovered from the phase-separated system.

If the phase-separated system has been formed by stopping the mixing and allowing the two phases to separate passively, the refined oil phase is easily recovered by emptying the vessel in which the extraction took place. If the vessel is emptied from the bottom, the polyol-containing solvent phase (which normally has a higher density than the vegetable oil phase) will leave first followed by the vegetable oil phase.

If auxiliary solvent has been used during the process, the recovered vegetable oil may contain some of it, and it may be necessary remove auxiliary solvent from the recovered vegetable oil. Thus, in some embodiments of the invention step e) furthermore involves removing auxiliary solvent from the recovered oil phase.

The removal of the auxiliary solvent may e.g. involve techniques such as evaporation, distillation, and/or membrane separation. Guidance on the implementation of the techniques is e.g. described in Perry (1997).

Distillation, such as e.g. steam distillation, is a presently preferred technique, but other techniques may also be used.

In some preferred embodiments of the invention, the method of the present invention does not involve deodorisation, i.e. distillation of the vegetable oil using temperatures >180 degrees C.

The recovered vegetable oil may contain traces of the polyol-containing solvent, which can be removed by a gentle short time thin layer distillation exposing the lipid to a minimum of thermal stress. Alternatively, or additionally, the polyol-containing solvent may be removed by solid phase absorption. Useful examples of solid phases for solid phase absorption are e.g. silicate, bentonite and/or bleaching clay.

It is furthermore possible to recover free fatty acids from the polyol-containing phase, e.g. by acidification followed by gravity separation. The resulting polyol-containing solvent can be reused, e.g. by reusing it in the present refining process.

The extraction of step c) and the subsequent steps d) and e) can take place as a simple batch process, e.g. mixing unrefined vegetable oil and alkalizing agent with polyol-containing solvent or, alternatively, a blend of polyol-containing solvent and an auxiliary solvent, in a suitable tank to create good contact between the two separate liquid phases. After the mixing step, the separation into two phases may take place e.g. by passive settling or by using separators.

Alternatively the extraction of step c) and the subsequent steps d) and e) may be performed in continuous extractors, such as e.g. co- or counter-flow columns equipped with active or static mixing elements to form an intensive interphase contact.

Thus the method of the invention may e.g. be implemented as a batch process or as a continuous process.

The present method provides a particularly gentle ways of the refining the vegetable oil without exposing the vegetable oil to excessively high temperatures.

In some preferred embodiments of the invention the temperature of the vegetable oil does not exceed 170 degrees C. during the refining process, and preferably the temperature of the vegetable oil does not exceed 150 degrees C. It is even more preferred that the temperature of the vegetable oil does not exceed 130 degrees C. during the refining process.

In some preferred embodiments of the invention the temperature of the vegetable oil does not exceed 100 degrees C. during the refining process.

By avoiding the high temperature processes of the prior art the method of the present invention makes it possible to produce refined vegetable oil with lower energy consumption and thus a lower $CO_2$-emission.

In comparison with the prior art refining methods, the method of the present invention may give rise to faster processing of the vegetable oil to be refined, as the deodorisation step preferably is omitted. In some embodiments of the invention the total processing time for the vegetable oil is at most 30 minutes, preferably at most 20 minutes, and even more preferably at most 15 minutes. For example, the total processing time for the vegetable oil may be at most 10 minutes.

Yet an aspect of the invention relates to a refined vegetable oil obtainable by the method described herein.

The relatively low temperatures used in the present invention advantageously reduce the contents of trans fatty acids of the resulting refined vegetable relative to refined vegetable oils prepared using prior refining methods. The refined vegetable oil of the present invention preferably has a content of trans fatty acids of at most 1% (w/w), and even more preferred at most 0.5% (w/w), such as at most 0.1% (w/w) relative to the total weight of the refined vegetable oil.

It should be noted that embodiments and features described in the context of one of the aspects or embodiments of the present invention also apply to the other aspects or embodiments of the invention.

The invention will now be described in further details in the following non-limiting examples.

EXAMPLES

The following examples illustrate but do not limit this invention. All parts and proportions are by mass unless stated otherwise.

A number of refined oil samples have been produced using different variants of the present method and methods available in the prior art. The samples were analysed as described below.

Analytical Procedure

Each sample was dissolved in a pyridine/hexane mixture (50:50) or in chloroform, derivatized with N-methyl-N-trimethylsilyl-trifluoroacetamide (MSTFA) and 15 analysed on an Agilent 6890N gas chromatograph equipped with a FID detector and a split injection port. The column was a capillary J&W DB5 column and helium was used as carrier gas. Highly pure reference standards were used for establishing the correct calibration parameters for the analytes of interest.

The results of the analyses are summarised in Table 1 and 2.

Example 1 Extraction of Palm Oil with Aqueous Sodium Carbonate

Crude palm oil (25 g) was melted and hot water (50 g) and sodium carbonate (1.02 g) was added. The mixture was stirred at 100° C. for 60 min and transferred to a heated separating funnel at 80° C. The mixture was emulsified and no phase separation was observed after 60 min Example 2 Extraction of Palm Oil with Aqueous Sodium Carbonate and Ethyl Acetate Crude palm oil (25 g) was melted and hot water (50 g) and sodium carbonate (1.02 g) was added. The mixture was stirred at 100° C. for 60 min. The temperature was lowered to 60° C. and ethyl acetate (45 g) was added. The mixture was stirred for 30 min and transferred to a heated separating funnel at 60° C. After 30 min the two phases were separated. Ethyl acetate was removed from the lipid phase on a rotary evaporator prior to GC analysis. Along the same lines, water was removed from the aqueous phase on a rotary evaporator prior to GC analysis.

Example 3 Extraction of Palm Oil with Glycerol and Sodium Carbonate

Crude palm oil (25 g) was melted and glycerol (50 g) and sodium carbonate (1.02 g) was added. The mixture was stirred at 100° C. for 60 min and transferred to a heated separating funnel at 80° C. After 60 min the two phases were separated.

Example 4 Extraction of Palm Oil with Glycerol and Potassium Carbonate

As example 3, however 1.33 g potassium carbonate was used instead of sodium carbonate Example 5-7 Extraction of Palm Oil with Glycerol, Sodium Carbonate and Ethyl Acetate Crude palm oil (25 g) was melted and glycerol (50 g) and sodium carbonate (1.02 g) was added. The mixture was stirred at 100° C. for 60 min. The temperature was lowered to 60° C. and ethyl acetate (22.5 g in Example 5; 45 g in Example 6; and 90 g was added). The mixture was stirred for 30 min and transferred to a heated separating funnel at 60° C. After 30 min the two phases were separated. Ethyl acetate was removed from the lipid phase on a rotary evaporator prior to GC analysis.

Table 1 shows the results obtained in examples 1-7.

| Example | Extraction procedure Sample | Free glycerol % | FFA % | Mono-glyceride % | Di-glyceride % | Tri-glyceride % |
|---|---|---|---|---|---|---|
| Ref. A | Crude oil - No extraction | 0.08 | 15.48 | 3.22 | 7.53 | 73.57 |
| 1 | Aqueous sodium carbonate<br>No phase separation | n.a | n.a. | n.a. | n.a. | n.a. |
| 2 - Lipid phase | Aqueous sodium carbonate<br>Ethyl acetate | 0.03 | 2.07 | 2.11 | 8.83 | 86.94 |
| 2 - Aqueous phase | Aqueous sodium carbonate<br>Ethyl acetate | 0.84 | 78.82 | 7.69 | 2.94 | 9.71 |
| 3 - Lipid phase | Glycerol sodium carbonate | 0.43 | 0.19 | 1.20 | 8.70 | 89.47 |
| 3 - Glycerol phase | Glycerol sodium carbonate | 89.93 | 5.44 | 2.46 | 0.84 | 1.33 |
| 4 - Lipid phase | Glycerol potassium carbonate | 0.34 | 0.15 | 1.19 | 8.48 | 89.83 |
| 4 - Glycerol phase | Glycerol potassium carbonate | 92.90 | 4.99 | 1.90 | 0.08 | 0.12 |
| 5 - Lipid phase | Glycerol sodium carbonate<br>22.5 g Ethyl acetate | 0.14 | 0.43 | 2.17 | 9.74 | 87.45 |
| 5 - Glycerol phase | Glycerol sodium carbonate<br>22.5 g Ethyl acetate | 91.62 | 6.36 | 1.69 | 0.32 | 0.00 |
| 6 - Lipid phase | Glycerol sodium carbonate<br>45 g Ethyl acetate | 0.59 | 0.20 | 3.22 | 8.88 | 87.10 |
| 6 - Glycerol phase | Glycerol sodium carbonate<br>45 g Ethyl acetate | 91.55 | 6.77 | 0.61 | 0.26 | 0.81 |
| 7 - Lipid phase | Glycerol sodium carbonate<br>90 g Ethyl acetate | 0.18 | 0.28 | 3.27 | 9.47 | 86.73 |
| 7 - Glycerol phase | Glycerol sodium carbonate<br>90 g Ethyl acetate | 92.88 | 6.27 | 0.67 | 0.17 | 0.00 |

In conclusion the use of glycerol and an alkalizing agent, e.g. sodium carbonate or potassium carbonate, allows for selective removal of free fatty acids (FFA) with only a small loss of monoglyceride from the oil. The additional use of an auxiliary solvent such as ethyl acetate (see examples 5-7) appears to further improve the selectivity of the removal of FFA.

Example 8-11 Distillation of Palm Oil

Crude palm oil was distilled on a UIC KDL 5 short path distillation plant. The evaporation pressure was 0.21 mbar and the evaporation temperature was varied between 150-180° C. After distillation the remnants were analysed.

TABLE 2

Distillation of palm oil

| Example | Extraction procedure Sample | Free glycerol % | FFA % | Mono-glyceride % | Di-glyceride % | Tri-glyceride % |
|---|---|---|---|---|---|---|
| Ref. B | Crude palm oil - no distillation | 0.01 | 12.62 | 1.73 | 7.87 | 77.78 |
| 8 | After distillation T = 150° C. | 0.01 | 4.46 | 1.61 | 7.71 | 86.22 |
| 9 | After distillation T = 160° C. | 0.01 | 1.38 | 1.05 | 7.52 | 90.05 |
| 10 | After distillation T = 170° C. | 0.01 | 0.42 | 0.67 | 7.68 | 91.22 |
| 11 | After distillation T = 180° C. | 0.00 | 0.20 | 0.36 | 7.55 | 91.90 |

The results from examples 8-11 demonstrate that it was impossible by short path distillation to reduce FFA in the oil to a low level without removing most of the monoglyceride.

Example 12 Comparison of Methods for Removal of FFA

It has been demonstrated in examples 3-7 that extraction with a polyol-containing solvent such as glycerol, an alkalizing agent, and optionally an auxiliary agent such as ethyl acetate, is superior for selective removal of FFA from vegetable oils in comparison to the distillation approach of examples 8-11, when loss of monoglyceride from the oil must avoided or at least reduced.

Example 13 Extraction of Oat Oil with Glycerol and Sodium Hydroxide

Several extraction experiments have been performed on oat oil using glycerol as solvent and sodium hydroxide as alkalising agent.

The experiments employed 0.1-1% (w/w) NaOH and weight ratios between oat oil and glycerol in the range of 40:60-60:40.

In each experiment, a total volume of 100 mL mixture of oat oil, glycerol and NaOH were vigorously mixed for approx. 1 minute and the resulting mixture was then allowed to phase-separate passively for 24 hours.

After 24 hours of passive phase separation all samples were inspected visually, the oil phase was recovered and the residual glycerol from the oil phase was removed using short path distillation and a distillation temperature of 130 degrees C.

The content of FFA, mono-, di- and triglyderides of the resulting samples of refined oat oil was determined as described above, and the results confirmed that selective removal of FFA relative to mono-, di- and triglycerides also takes place when performing the extraction procedure of the present invention on oat oil. The present experiments furthermore demonstrate that NaOH is a useful alkalizing agent.

REFERENCES

Anderson (2005) Dan Anderson, Bailey's Industrial Oil and Fat Products, Sixth Edition, Six Volume Set. Edited by Fereidoon Shahidi, 2005 John Wiley & Sons, Inc.

Harper (2001) Tony Harper, "Recent Developments in Chemical and Physical Refining", page 21-26; Proceedings of the World Conference on Oilseed Processing Utilization, Editor. Wilson R. F. AOCS Press, Champaign, Ill.

WO 98/18888

Greyt et al (2005) W. De Greyt and M. Kellens; chap. 3, p. 341-385, Bailey's Industrial Oil and Fat Products, Sixth Edition, Six Volume Set. Edited by Fereidoon Shahidi, 2005 John Wiley & Sons, Inc.

Gunstone (2002) Frank Gunstone; "Vegetable Oils in Food Technology, Composition, Properties and Uses", 2002, CRC Press.

Perry (1997) Perry R. H. and Green D. W., "Chemical Engineers' Handbook" 7th edition, e.g. Section 15 and 18, McGraw-Hill, 1997

The invention claimed is:

1. A method of producing a refined vegetable oil, the method comprising:

a) providing a vegetable oil comprising triglycerides, diglycerides, monoglycerides and free fatty acids, where the vegetable oil contains free fatty acids in an amount of at least 5% by weight relative to the weight of the vegetable oil, b) contacting the vegetable oil with a polyol-containing solvent comprising one or more $C_3$-$C_8$ polyol(s) containing at least 3 hydroxyl groups and an alkalizing agent, thereby forming a first composition, said first composition containing water in an amount of at most 2% by weight relative to the weight of the first composition, c) extracting free fatty acids to the polyol-containing solvent at a temperature in the range of 50-150 degrees C., whereby the free fatty acids in the vegetable oil migrate to the polyol-containing solvent, d) forming a phase-separated system comprising a separate polyol-containing solvent phase including free fatty acids extracted from the vegetable oil and alkalizing agent and a separate oil phase, and e) recovering the oil phase from the phase-separated system to obtain a refined vegetable oil.

2. The method according to claim 1, wherein the vegetable oil comprises one or more vegetable oil(s) selected from the group consisting of palm oil, palm kernel oil, olive oil, soy oil, rapeseed oil, sunflower oil, safflower oil, cottonseed oil, shea butter, coconut oil, cocoa butter, linseed oil, corn oil, rice bran oil, avocado oil, oat oil, and a combination thereof.

3. The method according to claim 1, wherein the vegetable oil contains triglyceride in an amount of at least 50% by weight relative to the weight of the vegetable oil.

4. The method according to claim 1, wherein the vegetable oil contains a total amount of mono-glyceride of at least 0.1% by weight relative to the weight of the vegetable oil.

5. The method according to claim 1, wherein the polyol-containing solvent comprises glycerol.

6. The method according to claim 1, wherein the polyol-containing solvent comprises glycerol in an amount of at least 90% by weight relative to the weight of the polyol-containing solvent.

7. The method according to claim 1, wherein the first composition comprises the polyol-containing solvent in an amount of at least 10% by weight relative to the weight of the first composition.

8. The method according to claim 1, wherein the first composition comprises the vegetable oil in an amount of at least 10% by weight relative to the weight of the first composition.

9. The method according to claim 1, wherein the alkalizing agent is a salt of an organic or inorganic Bronsted acid.

10. The method according to claim 1, wherein the first composition furthermore comprises an auxiliary solvent.

11. The method according to claim 1, wherein an auxiliary solvent is added to the first composition during step c).

12. The method according to claim 10, wherein the auxiliary solvent comprises ethyl acetate.

13. The method according to claim 1 wherein step e) furthermore involves removing auxiliary solvent from the recovered oil phase.

14. The method according to claim 11, wherein the auxiliary solvent comprises ethyl acetate.

* * * * *